United States Patent [19]

Lonn et al.

[11] Patent Number: 4,883,129

[45] Date of Patent: Nov. 28, 1989

[54] BIT ASSEMBLY UTILIZING CARBIDE INSERT

[75] Inventors: Alan H. Lonn, Edelstein, Ill.; Daniel W. Nelson, Rogers, Ak.

[73] Assignee: Caterpillar Inc., Peoria, Ill.

[21] Appl. No.: 285,565

[22] Filed: Dec. 16, 1988

[51] Int. Cl.[4] ..... E02F 9/28; E02F 3/815; E21C 35/18

[52] U.S. Cl. ..... 172/777; 37/266; 37/141 R; 172/701.3; 172/747; 299/92

[58] Field of Search ..... 299/88, 89, 91, 92; 172/701.1, 701.2, 701.3, 777, 766, 747, 713; 37/142 R, 141 T, 142 A, 141 R, 266

[56] References Cited

U.S. PATENT DOCUMENTS

| | | | |
|---|---|---|---|
| 1,540,314 | 6/1925 | Clark | 37/141 T |
| 2,036,111 | 3/1936 | Wilson | 299/88 X |
| 2,702,698 | 2/1955 | Snyder | 299/88 |
| 2,771,693 | 11/1956 | Busque | 172/777 |
| 3,063,175 | 11/1962 | Petersen | 37/142 R |
| 3,143,177 | 8/1964 | Galorneau | 299/91 |
| 3,312,504 | 4/1967 | Mäkinen | 172/762 |
| 3,529,677 | 9/1970 | Stephenson | 172/767 |
| 3,575,467 | 4/1971 | Davis | 299/92 |
| 3,934,654 | 1/1976 | Stephenson | 172/747 |
| 4,006,936 | 2/1977 | Crabiel | 299/89 |
| 4,335,921 | 6/1982 | Swisher | 299/86 |
| 4,595,241 | 6/1986 | Gilbert | 299/93 |
| 4,753,299 | 6/1988 | Meyers | 172/777 |

FOREIGN PATENT DOCUMENTS

| | | | |
|---|---|---|---|
| 165834 | 10/1955 | Austria . | |
| 140523 | 5/1953 | Sweden | 172/777 |
| 306308 | 6/1955 | Switzerland | 172/701.3 |
| 1527588 | 10/1978 | United Kingdom . | |

OTHER PUBLICATIONS

Publication No. REP-0488 by G. H. Hensley, undated.

*Primary Examiner*—Richard J. Johnson
*Attorney, Agent, or Firm*—J. W. Burrows

[57] ABSTRACT

Ground engaging bits used in abrasive road grading applications utilizing carbide inserts brazed to the leading face of the steel tip are beneficial on motor grader blades. Commercial road grading bit assemblies used consistent thickness, rectangular carbide inserts brazed to the leading edge of the steel tip. Due to wear and high residual stresses imparted upon the insert from the brazing operation, premature cracking and breaking of the carbide inserts occur. The subject bit arrangement utilizes a carbide insert with a flat rectangular cutting face of non-constant thickness brazed to a leading edge of a steel body. The carbide insert has a thickness that increases from the top of the carbide insert and reaches a maximum at the bottom of the steel body, where bit wear is the greatest. The increasing thickness of the carbide tip extends bit life over the current rectangular design and allows for a more efficient and economical use of the carbide. This design also reduces the residual stresses in the carbide insert which normally occur during the brazing operation, thus substantially reducing cracking and breaking, and further extending bit life.

13 Claims, 2 Drawing Sheets

BIT ASSEMBLY UTILIZING CARBIDE INSERT

TECHNICAL FIELD

This invention relates generally to earth working bit assemblies and more particularly to bit assemblies utilizing carbide inserts for earth grading applications.

BACKGROUND ART

Earth working bit assemblies utilizing hardened insert cutting edges are commonly employed in various types of earth grading applications. Many bit assemblies are used for attachment on, but not limited to, motor grader moldboards.

Due to the various earth conditions that motor grader bit assemblies are subjected to, many modifications of the motor grader bit assemblies have been developed. For the grading of soft earth formations, a single, replaceable cutting edge bolted to the lower edge of the moldboard is adequate. But when the dressing of hard impacted, rough, and abrasive earth formations is needed, the continuous steel edge mentioned above is quite inadequate.

It has been widely known that to extend the life of the cutting edge one must merely add hardened inserts, usually of tungsten carbide. One of the known grader bit assemblies is shown in U.S. Pat. No. 3,529,677 to E. W. Stephenson issued on Sept. 22, 1970. In this arrangement a plurality of carbide inserts were brazed side by side in a continuous slot all along the bottom surface of the cutting edge attachment. This grader bit assembly prolonged the life of the cutting edge, but many problems still remained with its utilization. In hard, compacted earth formations, the continuous cutting edge prevented the blade from penetrating the upper portion of the ground and the blade tended to ineffectively slide along the top portion of the earth surface.

Another disadvantage of the continuous edge became apparent in applications where the earth surface was highly abrasive and rock impacted. The continuous cutting edge, formed by the hardened inserts, tended to crack and chip due to high forces imparted onto the edge by the hard, rock impacted earth surface. Many of the carbide inserts tended to dislodge, causing an irregular edge and premature loss of the expensive carbide. Once the carbide chipped or became dislodged, the steel edge wore at an accelerated rate.

It has been shown that a discontinuous cutting edge is far superior in performance on hard surfaces than is a continuous edge. When the discontinuous cutting edge was constructed of steel, problems occurred. Due to the high downward pressure needed to penetrate the hard upper earth surface, tooth breakage often occurred. This resulted in significant downtime and cost. Another problem occurred when sudden penetration of the hard earth surface took place due to the high downward pressure applied to the grader blade. When sudden penetration occurred, usually at irregular intervals, trenches were imparted into the graded surface, creating pockets of potholes and surface irregularities.

U.S. Pat. No. 4,753,299 to Thomas A. Meyers issued on June 28, 1988, proposed to alleviate the above problems associated with grading of hard earth surfaces and provide a blade bit assembly that reduced downtime associated with broken and worn carbide cutting edges and the replacement of carbide inserts. The invention provided a moldboard attachment that has a plurality of pick assemblies attached thereto. The pick assemblies each has a singular, thin rectangular carbide insert brazed to the leading edge of the pick assembly. The moldboard pick assembly provides an adequate grading action on harsh earth surfaces, and provides for replacement of individual picks when wear and breakage occur, but many difficulties are still associated with this arrangement.

The main disadvantage of the above arrangement is in the nature and design characteristics of the pick assembly. Because the insert is located on the leading face of the pick body, it encounters high impact forces and high forces urging the bit assembly downward. These forces tend to crack and break the carbide insert. This leads to premature tool wear out, inefficient loss of carbide, and accelerated wear of the leading face.

Due to the design and the properties of the carbide insert, cracking and breakage of the insert frequently occurs. The thin carbide insert is brazed to the leading face of the pick assembly. Due to the differing coefficients of thermal expansion, the steel expands and contracts more rapidly than does the thin rectangular carbide insert. This results in the steel imparting high residual stresses onto the adjacent carbide insert due to the differing rates of expansion and contraction. The problem is further accentuated by the fact that the arrangement uses a thin rectangular piece of carbide. The combination of the thin carbide (small cross sectional area between the front and rear surfaces) and the differing coefficients of thermal expansion results in severe cases of cracking and breakage of the carbide inserts when used in applications on hard and/or rock impacted surfaces.

Another disadvantage of the above arrangement is apparent when the phenomena of "rolling" takes place. As the moldboard pick assembly grades a rough, abrasive surface, the inserts actually shave the material from the earth's surface. As the material is shaved, it rolls under the pick assembly base and wears away the steel support behind the insert. The steel support acts as a reinforcing support member. Without the steel support behind the insert, large portions of the carbide insert breaks off as a result of the forces encountered while grading.

To alleviate the rolling phenomena a second rectangular carbide insert was added at a spaced location behind the first insert and parallel thereto. The rolling phenomena now occurs behind both inserts, allowing both inserts to lose their needed steel support and subsequently causes both inserts to crack and break away. The addition of the second insert only increases the cost of the pick assembly due to the increased amount of carbide and the extra machining required to properly locate the second carbide insert.

The present invention is directed to overcoming one or more of the problems as set forth above.

DISCLOSURE OF THE INVENTION

In one aspect of the present invention an earth working bit assembly is provided. The earth working bit assembly includes a body having a leading surface and an insert having a top and bottom portion and first and second opposed surfaces. The thickness of the insert, between the first and second opposed surfaces, increases from the top portion to the bottom portion. The first opposed surface of the insert is bonded to the leading surface of the aforementioned body.

The present invention provides an earth working bit assembly for use in motor grader applications where the earth surface is rock impacted, abrasive, and/or hard compacted. When the subject bit assembly is utilized under the above mentioned harsh conditions, the unique design of the increasing thickness carbide insert does not have a tendency to crack or chip. The generally trapezoidal shape of the carbide insert also better disperses the residual stresses induced during the brazing operation and in addition provides a more economical use of the expensive carbide. It is recognized that a large thick rectangular carbide insert would function much better than the thin insert, but the extremely high cost of the extra carbide makes the bit assembly commercially unacceptable.

A bit assembly utilizing the new trapezoidal shaped carbide insert has drastically prolonged tool life, downtime relating to bit assembly wear and/or breakage has been substantially reduced, and carbide chipping and breaking has all but been eliminated. Therefore, the consumer will receive a longer lasting, more durable, and more economical earth working bit assembly as a result of the present invention.

BEST MODE FOR CARRYING OUT THE INVENTION

Figure 1:
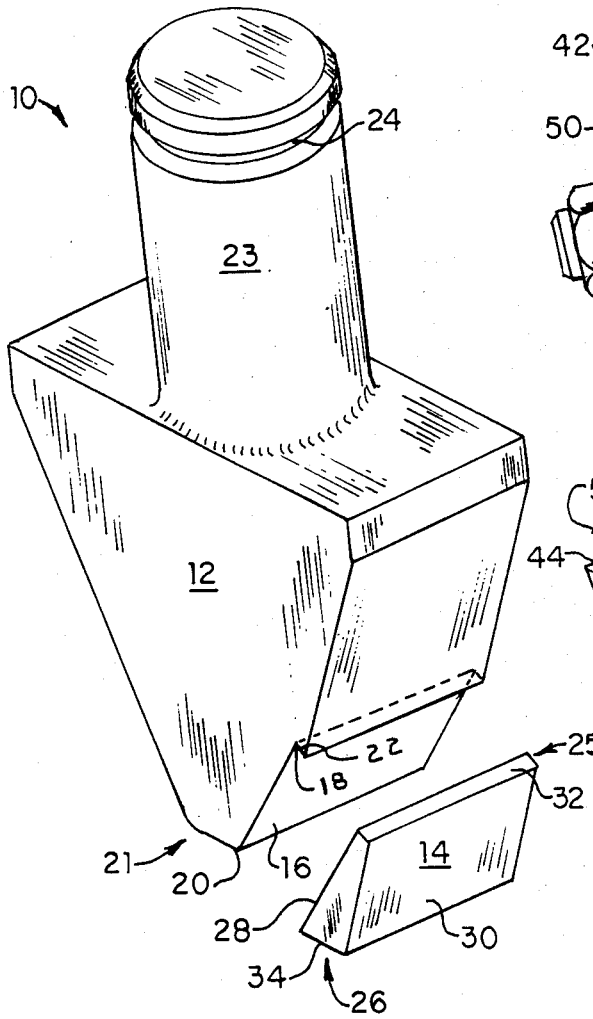
FIG. 1 is an isometric drawing showing the bit assembly with the trapezoidal like shape of the carbide insert take aside thereof to better illustrate the present invention.

Referring to the drawings, and more particularly to FIG. 1, an earth working bit assembly 10 is provided. The bit assembly includes a body 12 of hardened steel and a hardened insert 14 made of tungsten carbide.

The body 12 includes a substantially planar leading surface 16 having a top edge 18 and a bottom edge 20. The body 12 also includes a bottom heel portion 21 immediately adjacent the leading surface 16 and a shoulder 22 extending outwardly from the top edge 18 of the leading surface 16. The body further includes a supporting shank 23 defining a groove 24 therein and located adjacent the end of the shank 23.

The carbide insert 14 includes a top portion 25, a bottom portion 26, a first opposed surface 28 and a second opposed surface 30. The geometric shape of a section of the hardened insert 14 bounded by the top portion 25, the bottom portion 26, the first opposed surface 28 and the second opposed surface 30 is generally trapezoidal. The thickness of the hardened insert 1 between the first and second opposed surfaces 28,30 increases from the top portion 25 to the bottom portion 26. In the subject arrangement, the top portion 25 is a top end surface 32 while the bottom portion 26 is a substantially flat bottom end surface 34. The second opposed surface 30 of the carbide insert, when in use, is a generally planar working face and the bottom end surface 34 is generally perpendicular thereto.

The generally planar first opposed surface 28 of the carbide insert is bonded, for example, by brazing to the leading surface 16 of the body 12. The top end surface 32 of the hardened insert 14 is in contact with the shoulder 22 of the body 12. The shoulder 22 is operative to locate and support the hardened insert 14. The bottom end surface 34 of the insert 14 is immediately adjacent the bottom heel portion 21 of the body 12. The portion of the body immediately adjacent the bottom heel portion 21 provides an important support for the carbide insert 14. Without the support at the bottom heel portion 21, the carbide insert 14 will break or crack during operation.

Figure 2:
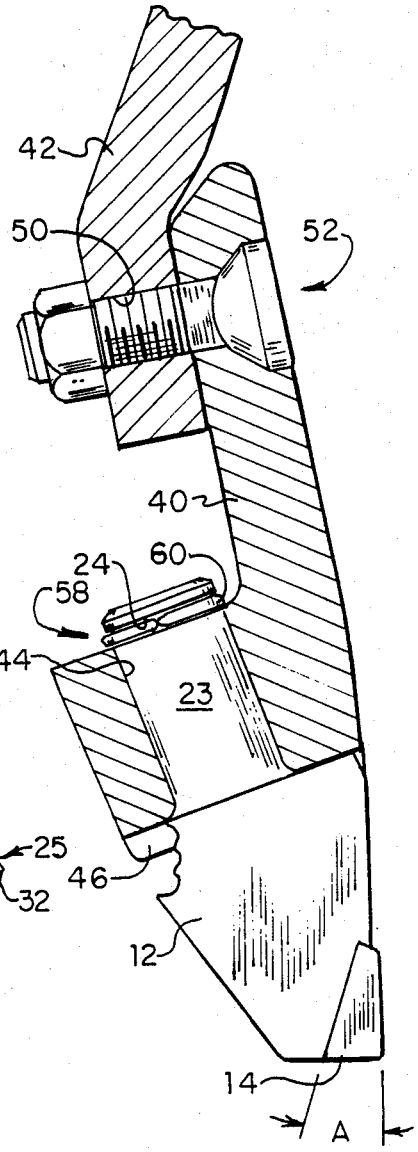
FIG. 2 is a cross-sectional side view of the present invention in combination with a motorgrader moldboard.
Figure 3:
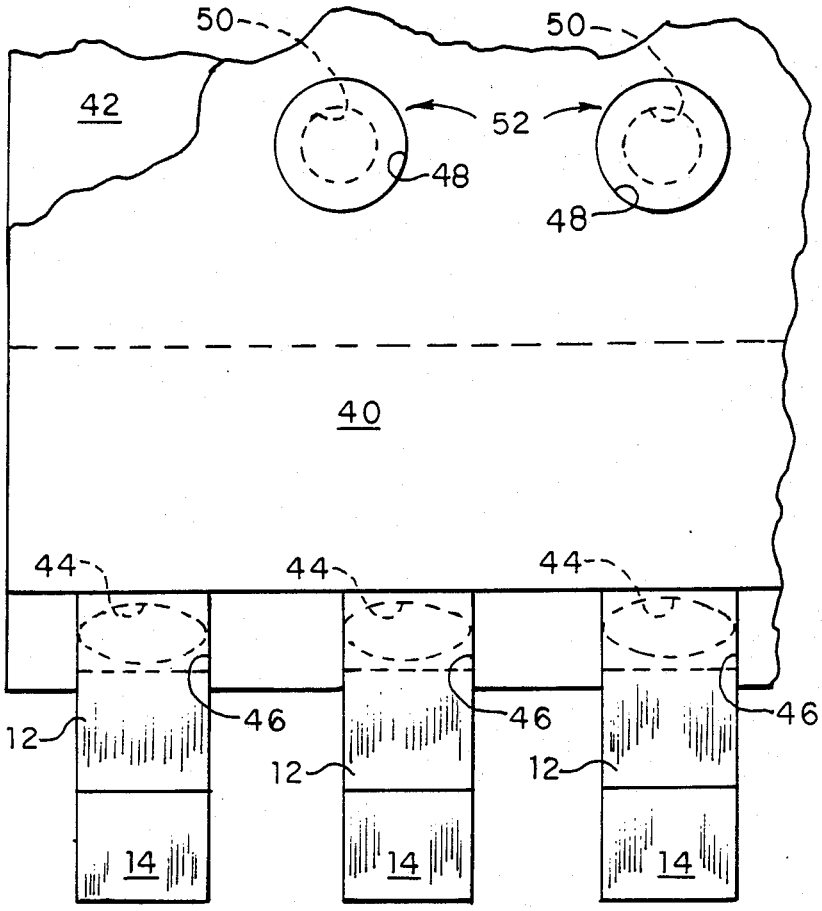
FIG. 3 is a front view of the present invention in combination with an elongated body member.

Referring now to FIGS. 2 and 3, the earth working bit assembly 10 is shown in combination with an elongated body member 40 and a lower portion of a moldboard 42 adapted for use on a motorgrader (not shown). The elongated body member 40 defines a plurality of sockets 44 located therein at equally spaced intervals. Each of the sockets 44 are adapted to receive the bit assembly 10.

A plurality of slots 46 are defined in the elongated body member 40. Respective ones of the slots 46 are located on the bottom of the elongated body member 40 perpendicular to the respective ones of the plurality of sockets 44. Each of the slots 46 has a width equal to the width of the body 12 and is operative to receive a portion of the body and prohibit the shank 23 of the body from turning within the respective socket 44. The elongated body member 40 also has a plurality of bolt holes 48 defined therein spaced one from the other and located in the upper portion thereof.

The moldboard 42 has a plurality of bolt holes 50 located in the lower portion thereof and spaced one from the other. The bolt holes 50 in the moldboard 42 and the bolt holes 48 in the elongated body member 40 are adapted to align one with the other when assembled. A plurality of nut and bolt assemblies 52 are provided and operative to secure the elongated body member 40 to the moldboard 42 in a conventional manner.

A means 58 is provided for retaining the bit assembly 10 to the elongated body member 40. The retaining means 58 includes a retaining ring 60. When assemblied, the retaining ring 60 is located in the groove 24 of the shank 23. It is recognized that other retaining means could be used without departing from the essence of the invention.

Industrial Applicability

The earth working bit assembly 10 as disclosed herein provides longer tool life and better utilization of the expensive carbide used in the hardened insert 14. In operation, the bit assembly 10 must withstand abrasive wear as well as impact loading.

The hardened insert 14 must be able to endure both impacts and abrasive wear. By having the insert 14 thicker at the bottom end portion 34, the insert 14 is able to wear for a longer time since more hardened surface area is exposed to the surface being worked. Even though the insert 14 reduces in thickness as the insert wears, the best cost to life ratio is achieved.

In order for the insert 14 to achieve better impact resistance, the bottom heel portion 21 of the body 12 is located behind and directly adjacent the bottom end surface 34 of the insert 14. The support created by the bottom heel portion 21 aids in eliminating chipping and breakage of the hardened insert 14.

The shape of the hardened insert 14 also aids in better impact resistance. It is well known that stresses may be induced into the insert 14 during the brazing of the insert 14 to the leading surface 16 of the body 12. These stresses are attributed to the different thermal expansion rates of the material in the body 12 and the material in the insert 14. During the heating phase, the steel of the body 12 expands at a greater rate than does the tungsten carbide of the insert 14. Likewise, during the cooling phase the steel shrinks at a greater rate than does the carbide. At an early stage of the cooling phase, the material of the brazing agent solidifies and secures the insert to the body. With further cooling, the faster shrinking rate of the steel in the body 14 results in the steel having a tendency to cause the outer perimeter of the insert to curl inwardly with respect to the body. This curling tendency results in the outer or opposed surface having a very high tensile force therein. The increasing thickness of the subject insert 14 substantially eliminates any tension being induced into the second opposed surface 30 thereof.

As best depicted in FIGS. 2 and 3, the bit assembly 10 is placed in the respective sockets 44 of the elongated body member 40 and secured therein by the retaining ring 60. The bit assembly 10 is prohibited from rotation since the respective portion of body 12 is received in the respective slot 46. The elongated body member 40 along with the attached bit assemblies 10 is then secured to the moldboard 42 by the plurality of nut and bolt assemblies 52 in a conventional manner.

It has been found that an insert 14 having an angle defined between the first and second opposed surfaces 28,30 ranging between 10 degrees and 45 degrees has worked satisfactorily. The best results have been achieved when using an angle of approximately 20 degrees.

During operation, the second opposed surface 30 is generally maintained perpendicular with the earth or surface being worked. It is recognized that the use of the word "earth" herein means any surface that one may wish to use the bit assembly 10 on while performing work.

Other aspects, objects, and advantages of the invention can be obtained from a study of the drawings, the disclosure and the appended claims.

What is claimed is:

1. An earth working bit assembly, comprising:

a body having a substantially planar leading surface and a hardened insert having top and bottom portions and first and second opposed surfaces, the thickness of said hardened insert, between said first and second opposed surfaces, increases from the top portion to the bottom portion and defines an angle in the range of 10 degrees ot 45 degrees, and the first opposed surface of said hardened insert is bonded to the leading surface of said body.

2. The bit assembly as set forth in claim 1, wherein said leading surface includes a top edge and a bottom edge, and said body includes a shoulder extending outwardly from the top edge of said leading surface.

3. The bit assembly as set forth in claim 2, wherein said top portion of said hardened insert is a top end surface of the hardened insert and said top end surface is in contact with said shoulder.

4. The bit assembly as set forth in claim 1, wherein said hardened insert is formed of tungsten carbide.

5. The bit assembly as set forth in claim 1, wherein the angle between the first and second opposed surfaces of the hardened insert is approximately 20 degrees.

6. The bit assembly as set forth in claim 1, wherein said first opposed surface of said hardened insert is bonded to said leading surface of said body by brazing.

7. The bit assembly as set forth in claim 1, wherein said body includes a supporting shank and the bit assembly is operative in use combined with an elongated body member defining a plurality of spaced apart sockets, and each of the sockets being operative to locate a respective bit assembly.

8. The combination as set forth in claim 7, including means for retaining the respective bit assembly to the elongate body member, said retaining means being releasably attached to the supporting shank of the bit assembly.

9. The combination as set forth in claim 8, wherein said retaining means is a retaining ring.

10. The combination as set forth in claim 8, further including a moldboard, said elongated body member being releasably attached to said moldboard.

11. An earth working bit assembly, comprising:

a steel body having a substantially planar leading surface and the leading surface having a bottom edge;

a carbide insert having top and bottom portions and first and second opposed surfaces, the thickness of the carbide insert, between the first and second opposed surfaces, increases from the top portion to the bottom portion and defines an angle in the range of 10 degrees to 45 degrees, and the first opposed surface of the carbide insert is brazed to the leading surface of the steel body and oriented so that the bottom portion of the carbide insert is adjacent the bottom edge of the leading surface of the steel body; and wherein the angle formed between the first and second opposed surfaces is selected to substantially eliminate tensile stresses being induced into the carbide insert during brazing of the carbide insert to the steel body and to increase the wear life of the carbide insert while minimizing the quantity of carbide material needed to make the carbide insert.

12. The earth working bit assembly as set forth in claim 11, wherein the angle defined between the first and second opposed surfaces of the carbide insert is approximately 20 degrees.

13. The earth working bit assembly as set forth in claim 11, wherein the carbide insert is made from tungsten carbide.

* * * * *